US009327165B2

(12) United States Patent
Melendez

(10) Patent No.: US 9,327,165 B2
(45) Date of Patent: May 3, 2016

(54) PROPULSION SYSTEM FOR USE BY A SWIMMER

(71) Applicant: Michael Melendez, Pompano Beach, FL (US)

(72) Inventor: Michael Melendez, Pompano Beach, FL (US)

( * ) Notice: Subject to any disclaimer, the term of this patent is extended or adjusted under 35 U.S.C. 154(b) by 0 days.

(21) Appl. No.: 14/600,809

(22) Filed: Jan. 20, 2015

(65) Prior Publication Data

US 2015/0224366 A1 Aug. 13, 2015

Related U.S. Application Data

(60) Provisional application No. 61/929,300, filed on Jan. 20, 2014.

(51) Int. Cl.
*B63C 11/46* (2006.01)
*A63B 35/12* (2006.01)

(52) U.S. Cl.
CPC ..... *A63B 35/12* (2013.01)

(58) Field of Classification Search
USPC ..... 114/315
IPC ..... A63B 35/12; B63H 21/17
See application file for complete search history.

(56) References Cited

U.S. PATENT DOCUMENTS

| | | | | | |
|---|---|---|---|---|---|
| 3,635,188 | A * | 1/1972 | Rutkowski | 440/6 |
| 4,700,654 | A * | 10/1987 | Borges | 114/338 |
| 4,996,938 | A * | 3/1991 | Cameron et al. | 114/315 |
| 5,024,178 | A * | 6/1991 | Bruce | 114/315 |
| 5,509,372 | A * | 4/1996 | Culotta | 114/315 |
| 6,036,555 | A * | 3/2000 | Takacs | 440/6 |
| 6,572,422 | B2 * | 6/2003 | Kirkwood et al. | 440/67 |

* cited by examiner

*Primary Examiner* — Stephen Avila

(57) ABSTRACT

A propulsion system, for use by a swimmer in both on-water and under-water applications, includes at least one power supply unit attached to a sleeve secured about and to a forearm of the swimmer, at least one corresponding propulsion unit including a motor and an impeller, the propulsion unit offset from the forearm near to the wrist and away from the head of the swimmer, and control elements that actuate the power and propulsion units. One control element includes a grip upon the flexion axis of the swimmer which controls pitch of a longitudinal axis of the propulsion unit relative to a forearm of the swimmer, the control elements include a pivotally secured bracket, and elements for control of the level of power provided to the propulsion unit, in which the rotation and control elements are both positioned for ease of accessibility by a hand of the swimmer.

16 Claims, 8 Drawing Sheets

PROPULSION SYSTEM FOR USE BY A SWIMMER

REFERENCE TO RELATED APPLICATION

This application claims the benefit under 35 USC 119(e) of provisional patent application Ser. No. 61/929,300, filed Jan. 20, 2014, which is incorporated by reference in its entirety.

BACKGROUND OF THE INVENTION

1. Field of Invention

The instant invention relates to a device for propulsion of a swimmer through the water and, more particularly, to a device and system which is mounted upon the forearm of the swimmer and which may be controlled by the hands and fingers thereof.

2. Prior Art

There is a demand for propulsion units for use by underwater as well as on-water swimmers, inclusive of snorkelers and scuba divers. As such, the term "swimmer" as used herein, includes on-water swimmers, surfers, underwater swimmers, scuba divers, and others. Certain propulsion units are also employed by lifeguards and certain handicapped or disabled persons. There, as well, is a need for improvement in the prior art of such vehicles by the military. The prior art in the present area includes the range of systems which are power operated, and includes arrangements in which the propulsion unit is attached to the back of a swimmer or about the torso and legs. Art of this nature is represented by U.S. Pat. No. 4,843,998 (1989) to Parker, entitled Submersible Drive Means; U.S. Pat. No. 5,2024,178 (1991) to Bruce, entitled Underwater Propulsion Device; U.S. Pat. No. 6,823,813 (2004) to Mazin, entitled Leg-Mounted Propulsion Device For Swimmers and Divers; and U.S. Pat. No. 6,848,385 (2005) to Mah, entitled Underwater Motor Device. This invention seeks to improve upon such prior art in terms of ease of use and minimizing any encumbrance to the swimmer or diver during the use thereof.

Another type of assembly known to the inventor is one known as the X2 Jet Pack in which one mounts a propulsion means to each forearm. However, in that each unit is fixed and parallel with the forearm, it offers no degree of movement other than that which is physiologically possible by the forearm of the swimmer. Further, the power source and other components of the X2 Jet Pack System are integrated within a body harness that is worn by the swimmer, resulting in power and control cables that are located between the swimmer's body and lower arms. Such cables and harness inherently encumber the swimmer or diver who must at all times be aware of the harness on the body which, in any event, increases the opportunity for snagging. A method of quick release of a thruster and cables in the event of snagging is not taught by or apparent from the X2 Jet Pack. Yet further, both propulsion units (or thrusters) of this system are controlled by a single hand-held button. As such, each thruster of the X2 Jet Pack is not operated independently thereby limiting the degree of control of the system.

Another type of system, similar to that of Mazin above, allows the swimmer to insert one forearm through a fixed diameter ring and grasp a fixed control handle with a button. The unit is fixed in parallel with the forearm and offers no additional degrees of movement beyond the swimmer's range of motion of the lower arm. The system's power source and propulsion unit are housed within a dry cylinder having a diameter larger than that of the propeller blade. Further, the batteries of this type of system cannot be changed under water and the unit is bulky to a swimmer.

Also known in the art are a variety of motorized sleds, which are relatively large units and require the swimmer to mount the sled, ride upon it and drive it and as if it were a separate vehicle (which it is). Many back powered units are bulky and, as such, are awkward for a diver to enter and leave the water with. Further, these units do not lend themselves to ease of maneuverability in the water because the propulsion unit is always fixed to the swimmer or to an air tank which in turn is attached to the swimmer.

Other popular swimmer and diver propulsion systems are the SeaDoo Scooter and the Bladefish, both of which require the use of two hands to grip the respective sides thereof.

The present invention thereby provides a propulsion unit of a type fixed to the forearm of a swimmer and which is maneuverable by one hand of the swimmer.

SUMMARY OF THE INVENTION

A propulsion system for use by a swimmer in both on-water or under-water applications, includes at least one power supply unit secured upon a sleeve secured about and to a forearm of the swimmer; at least one corresponding propulsion unit including a motor and an impeller, the motor in electrical communication with the motor controller, said propulsion unit within a housing, said propulsion unit having a bracket pivotally securing it to said sleeve, said unit extending in a direction laterally offset from said forearm and distally away from the head of the swimmer; and control means for said power and propulsion units, said control means including: (i) elements for controlling pitch of an axis of said propulsion unit relative to a forearm of the swimmer in which a rotation of the flexion axis of the wrist causes a change of the pitch of the longitudinal axis of the propulsion unit, said elements including said pivotally secured bracket; and (ii) elements for control of a level of power provided by said power unit to said propulsion unit, in which each of said pitch and power control means are positioned for ease of accessibility by a hand of the swimmer.

It is an object of the invention to provide a diver with a personally powered propulsion system which enables a user to have a high degree of maneuverability upon and under the water.

It is another object to provide an efficient and effective personal power propulsion system for swimmers and divers which enables the user to have enhanced maneuverability in and under the water and which, during use, can leave the user's hands free for the performance of desired tasks or actions.

It is a further object to provide an underwater propulsion device which has a propulsion unit attached to the forearm of a swimmer that can be used by swimmers, life guards, snorkelers divers, scuba divers and many other types of users.

It is a yet further object to provide a completely hand and wrist-operated under or in-water propulsion system attachable to the forearm of the swimmer in which speed and directionality can be fully controlled by the hand and wrist of the swimmer.

The above and yet other objects and advantages of the present invention will become apparent form the hereinafter set forth Brief Description of the Drawings, Detailed Description of the Invention and Claims appended herewith.

DETAILED DESCRIPTION OF THE INVENTION

In the prior art, a swimmer has a tank on his back which is attached to him by a harness. A power unit is typically provided integrally with an impeller unit upon the tank or about a waist and forearm of a swimmer 10.

Figure 1:
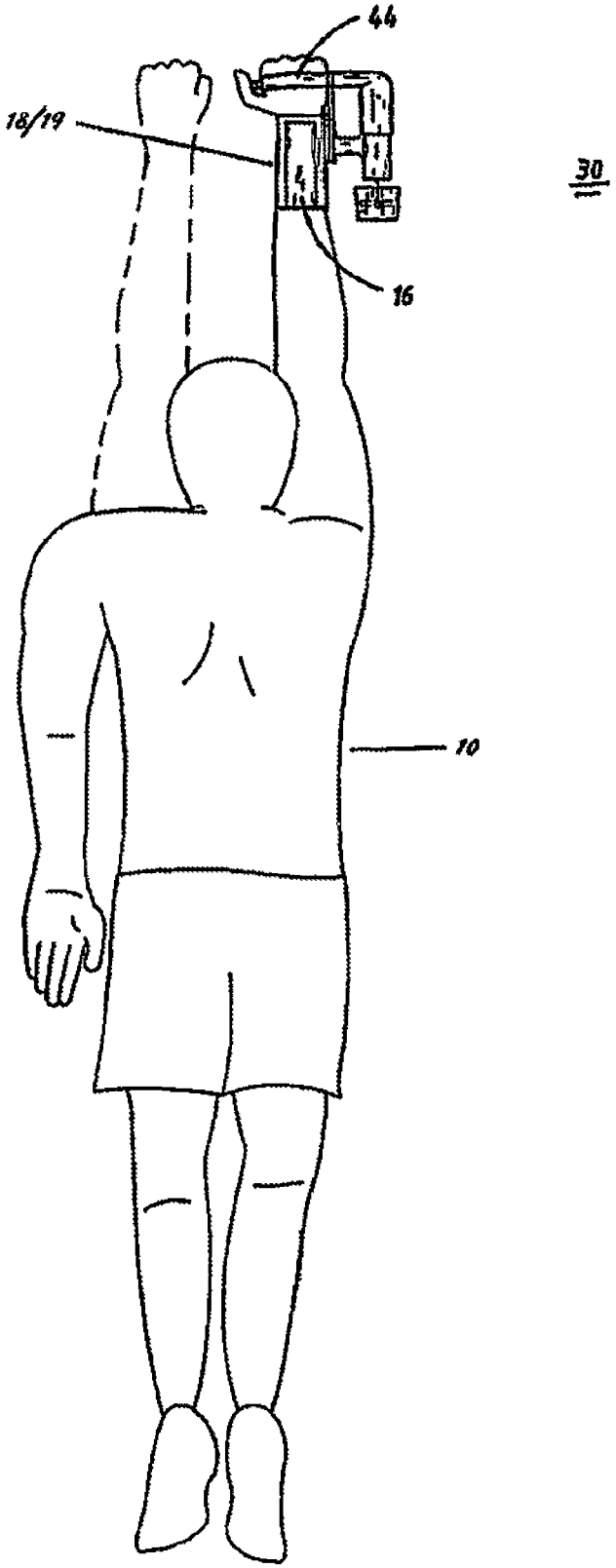
FIG. 1 is a top perspective view showing a swimmer equipped with the inventive propulsion system
Figure 2:
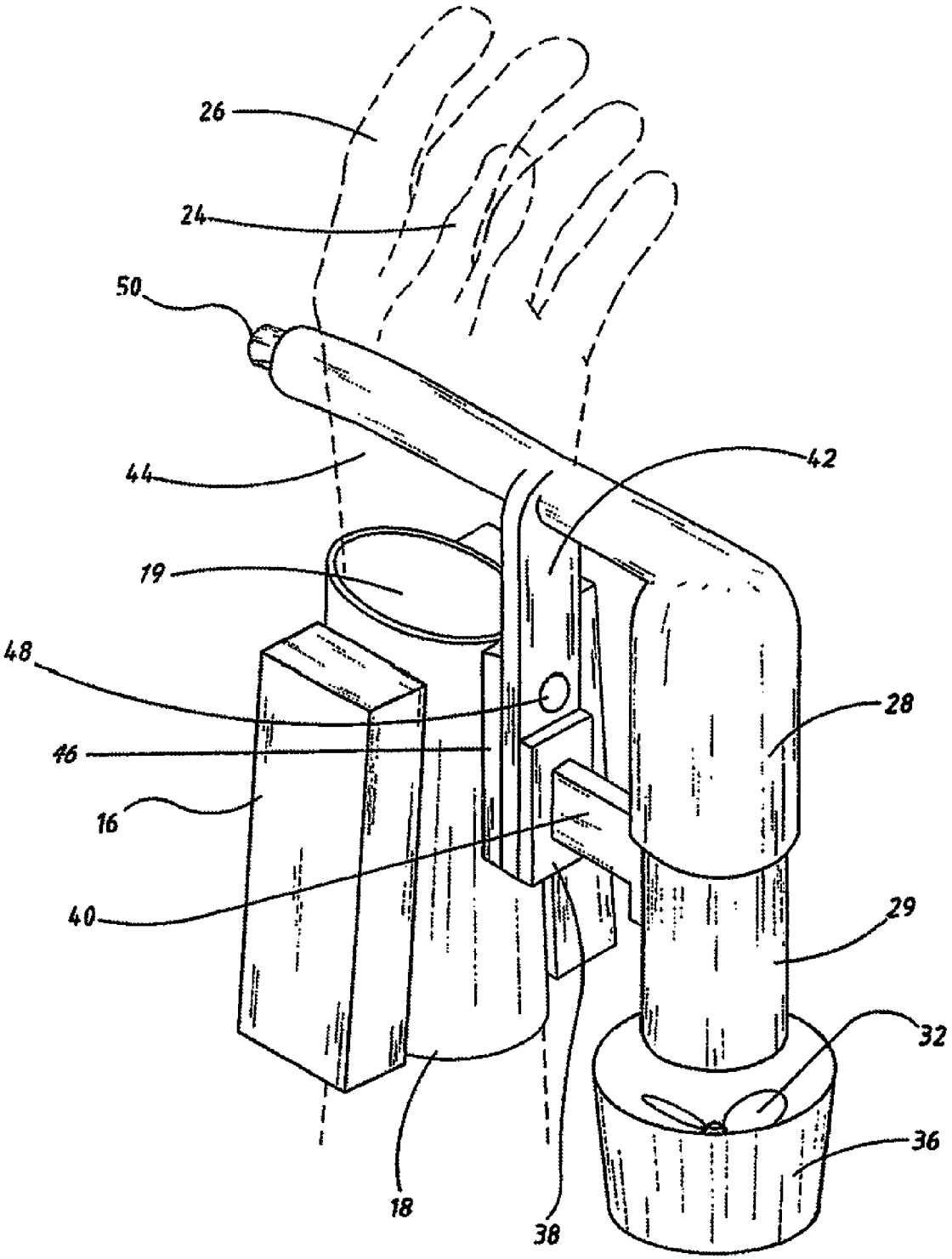
FIG. 2 is a perspective view of the present invention.

In the instant invention, two lithium batteries 16 and 16A (see FIG. 3), serve as the power supply of the system preferably connected in series to achieve an output of about 30V DC, and attached to a sleeve 18 or the like, which is typically be an extension of a wet suit of the swimmer 10. Within the sleeve 18 is forearm 19 and wrist 21 of the swimmer 10 from which extends thumb 24 and other fingers 26 of hand 22. The batteries 16/16A are in electrical communication with motor power controller 28 (see FIG. 2-4 and electrical block diagram of FIG. 8) which in turn drives a brushless motor 29 and an impeller 32 using a drive shaft 34. The batteries of the system are, as above noted, designed to attach to the sleeve or propulsion unit and can be connected or disconnected by the swimmer under or above the surface of the water. A cable connection (see FIG. 8) to the batteries may be removed by pulling their connections apart from cable 31 or simply removing cable 37 from the battery pack at point 33.

The impeller 32 is surrounded by a shroud 36 which functions as a nozzle thereby affording protection to the diver and of the impeller from foreign objects with which it might otherwise become entangled. As well, shroud or nozzle 36 also assures proper directionality of the thrust output of the system.

Propulsion unit 30 is secured to sleeve 18 by a bracket 38 (see FIGS. 2 and 3) which bracket includes a flat integral radial segment 40. Beneath bracket 38 is a flat elongate member 42 (see FIG. 4) which is bonded or otherwise secured to bracket 38 and which extends upwardly to a control handle 44, more fully described below.

Between sleeve 18 and elongate member 42 is a planar surface 46 which is secured to sleeve 18. See FIG. 4. Conformal to surface 46 is said elongate member 42. A pivot element 48 (also referred to as a quick release pin) is secured at its base within surface 46 such that member 42 as well as its associated bracket 38 and the entire prolusion unit 30 is rotatable about the axis of pivot element 48 using control handle 44 as a lever. The quick release pin may be a Clevis pin, thus enabling the necessary quick release, as may be needed. Also see FIG. 7. In addition, the pivot element (quick release pin) 48 provides at least the following additional functions:

1. It secures the propulsion unit 30 (see FIG. 6) to the swimmer's arm 19 by joining the planar surface 46, elongate member 42 and bracket 38 where the quick release pin 48 is inserted and through each of said elements while also permitting the pivoting of the propulsion unit 30/32/36.

2. Disengagement and removal of the quick release pin 48 allows the separation of the planar surface 46, elongate member 42 and bracket 38, permitting the propulsion unit to separate from the swimmer if desired, while concurrently permitting pivoting to continue until pin 48 is removed.

All components, including the power unit, power supply and propulsion unit can reside and operate below the swimmer's elbow if no cables or physical connections along the swimmer's upper arm 19 or around his shoulders, neck, head, torso, hips, legs or feet exist.

Figure 4:
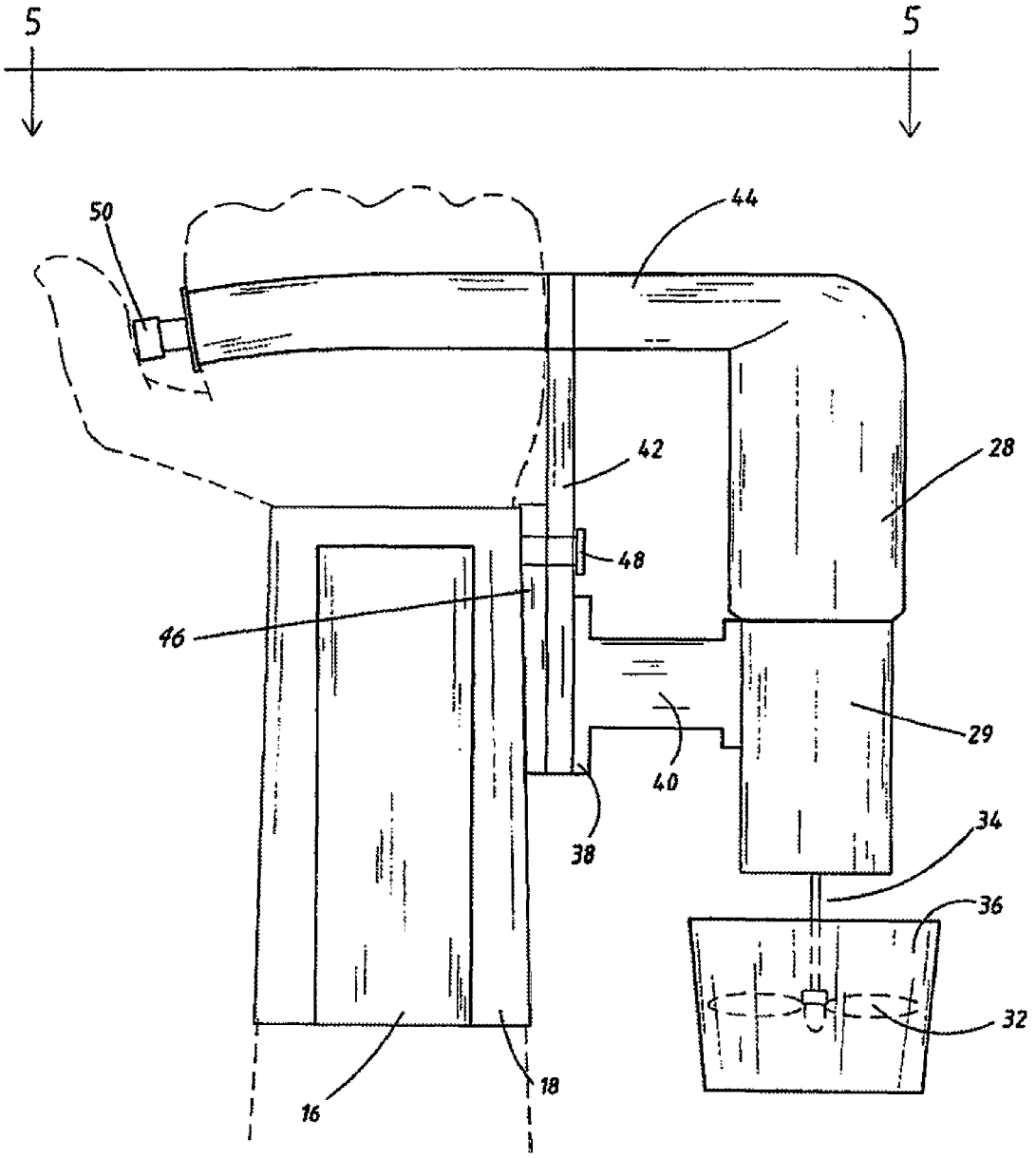
FIG. 4 is a top plan view showing the material components of the propulsion system, with certain integral elements thereof shown in phantom, and showing the Hall-effect switch proximally to a thumb of a hand of a swimmer and the control handle of the system engaged by the other fingers of the swimmer.
Figure 5:
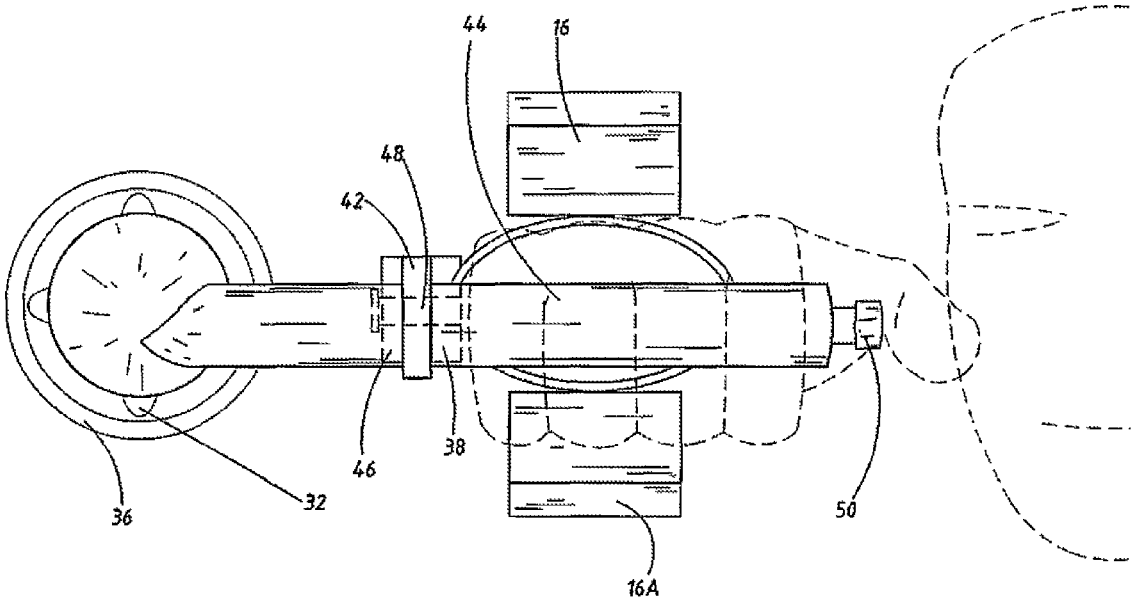
FIG. 5 is a front schematic view taken along Line 5-5 of FIG. 4.

A front view of the system along the axis of control handle 44 is shown in FIG. 5. Therein may also be seen Hall effect voltage controller 50. Depression of the button thereof regulates a pulsed width modulation (PWM) circuit 52 (see FIG. 8) which in turn acts on the motor power controller 28, which in turn regulates the DC power supplied by the power supply 16/16A to brushless motor 29 and, therewith, the extent of thrust that is generated by impeller 32. The electrical connections of block diagram of FIG. 8 are not shown in the mechanical renderings of FIGS. 2-7, which are well within the skill of one of ordinary skill in the art to provide in light of the disclosure herewith.

It is to be appreciated that Hall effect voltage controller 50, housed at a proximal end control handle stick 44, provides access by thumb 24 of the swimmer, either with or without use of one's other fingers 26. Further, it should be appreciated that pivot element 48 in combination with elongate member 42, and the elongated geometry of control handle 44, permit ease of mechanical rotation of the entire propulsion unit 30. See FIG. 4. That is, handle 44 in combination with member 42 permit the power unit 30 to be easily pivoted about said element 48. See FIG. 7.

Figure 3:
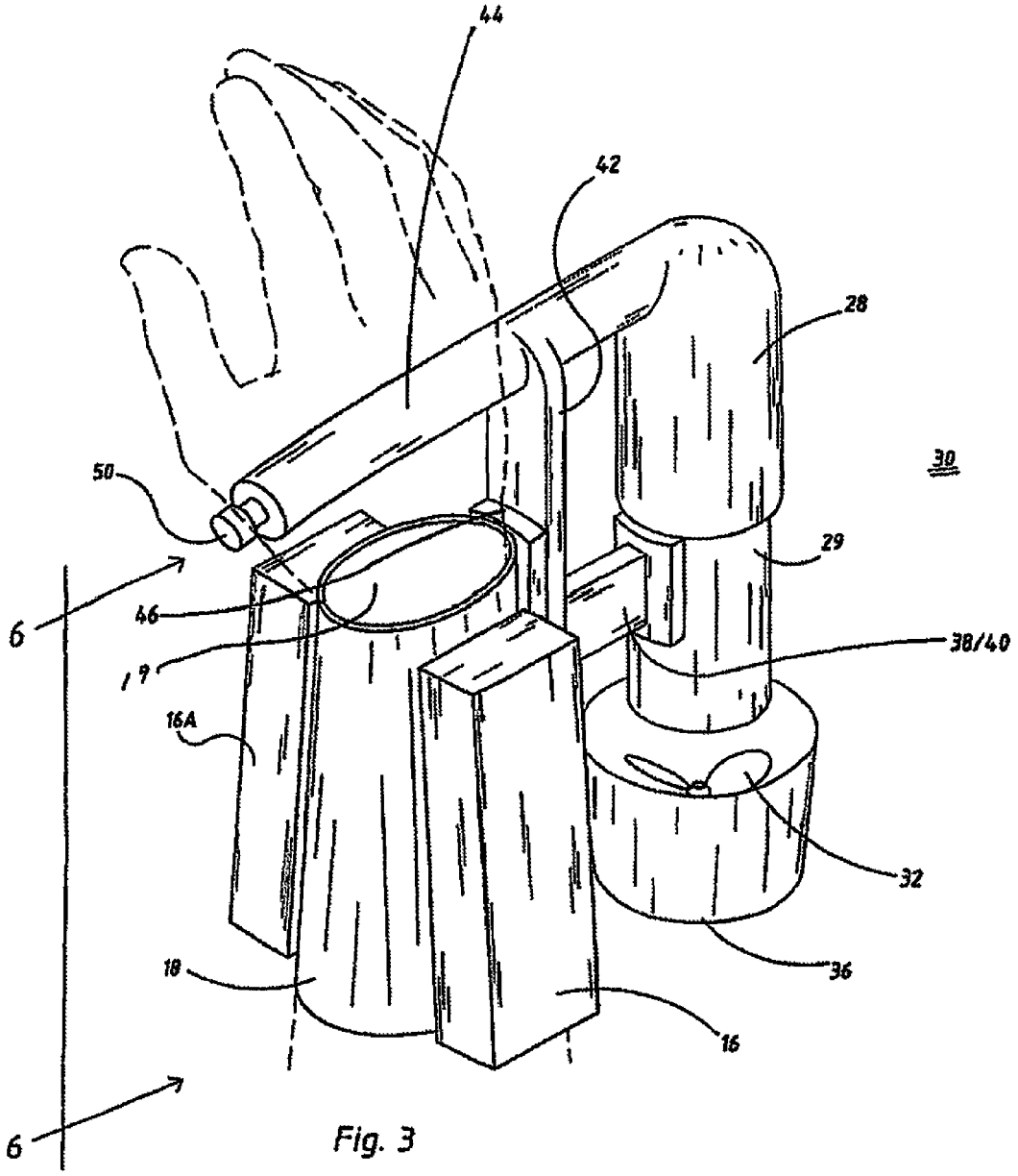
FIG. 3 is a view, generally similar to that of FIG. 2, however showing the location and manual control handle behind the hand of the user at such time when the use of the controls is not required by the swimmer.
Figure 6:
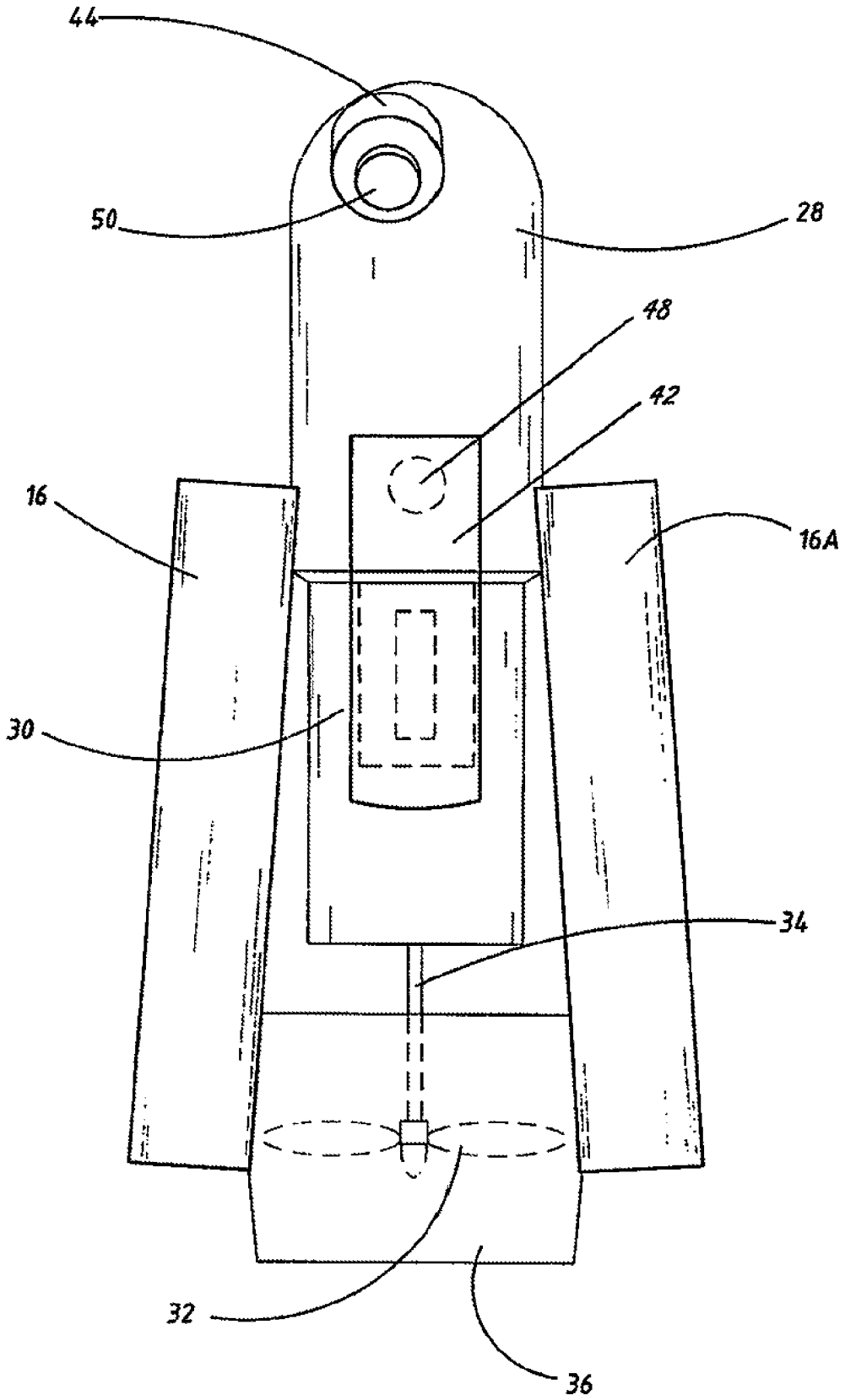
FIG. 6 is a side schematic view along Line 6-6 shown in FIG. 3.

FIG. 6 is a side view taken along the axis of control handle 44 in the direction shown along Line 6-6 of FIG. 3.

Figure 7:
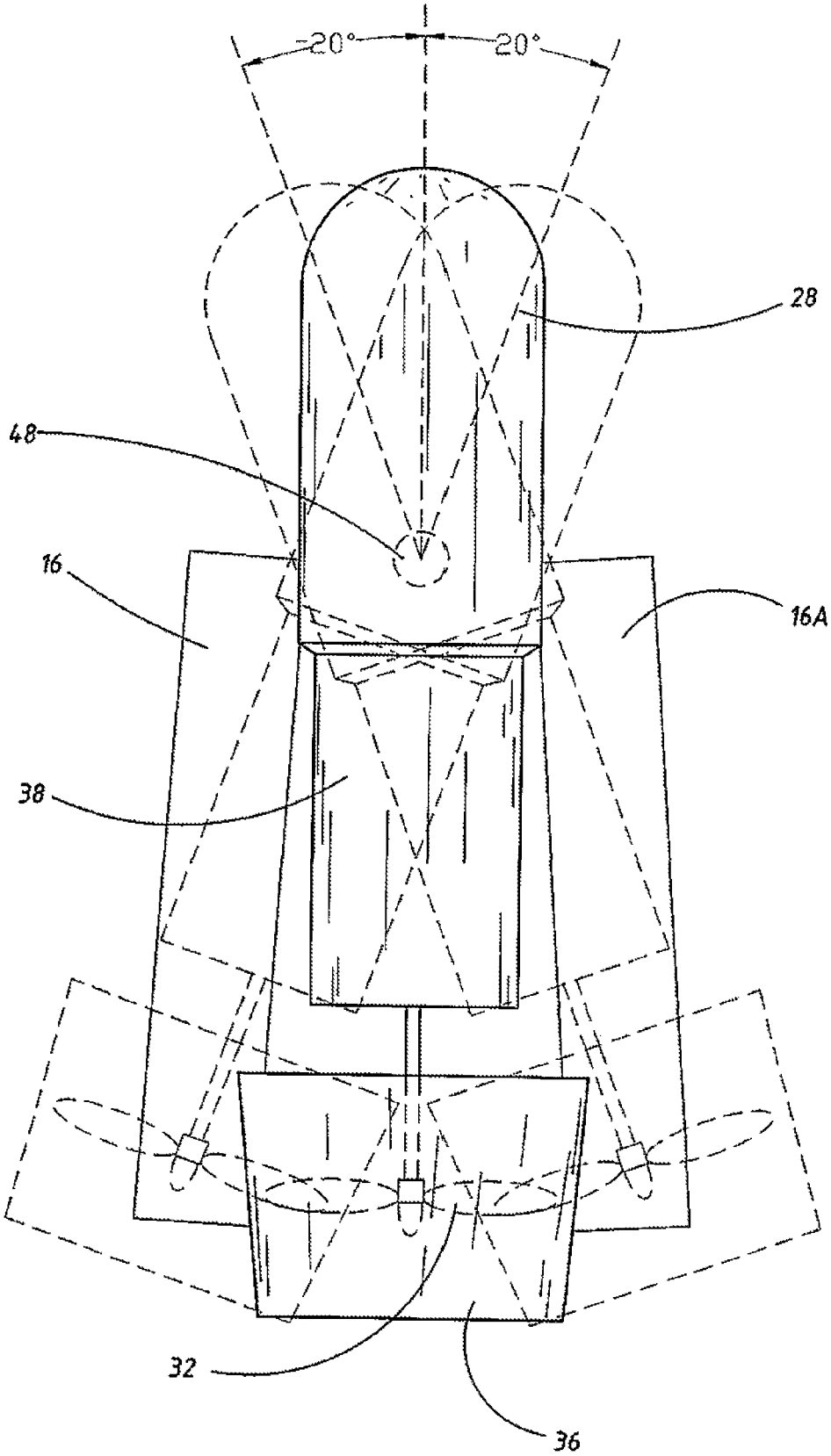
FIG. 7 is a conceptual view showing, in phantom, the rotation of the propulsion unit which is attached to the forearm of the swimmer using the mechanism for control of the pitch of the longitudinal axis of the propulsion unit, particularly showing a resulting tilting of a 20-degree wrist flexion of the swimmer relative to a pivot point of the system and, in phantom, a counterclockwise rotation of the propulsion unit relative to the forearm of the swimmer, the same corresponding to a minus 20 degree wrist flexion about the pivot point.
Figure 8:
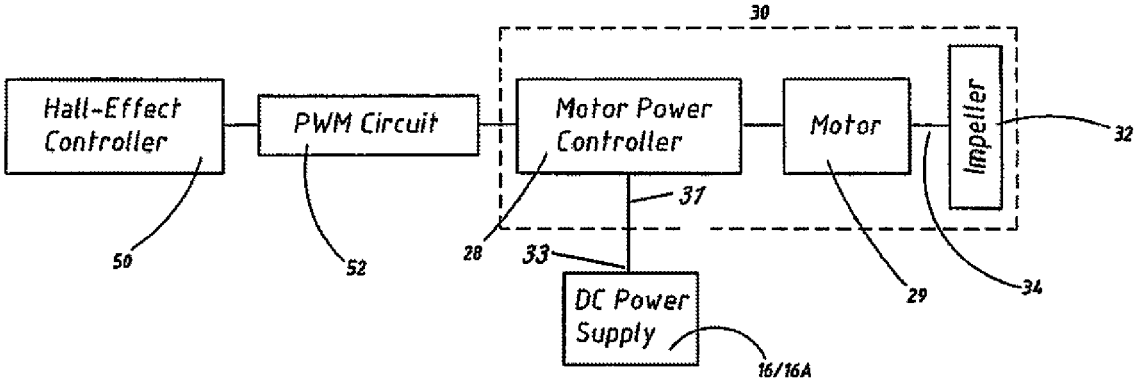
FIG. 8 is a general system component layout showing the inter-relationship of all electrical components of the instant invention.

With respect to FIG. 7, there may be seen positive and negative angulations of degrees of pitch of the propulsion unit that may be readily accomplished by extension or flexion of the wrist of the swimmer while engaging control handle 44. This, among other aspects, differs from the teaching of Bruce above (U.S. Pat. No. 5,024,178) in that positioning requiring movement of the shoulder or elbow of the swimmer is not necessary. Rather, one need only engage control handle 44 with the hand while flexing or extending the wrist to accomplish changes in degree of pitch of the propulsion unit, shown in FIGS. 7 and 8. Using the thumb, the Hall effect voltage controller 50 is also able to also control the degree of thrust generated by the instant system. As such, both to the pitch, either negative or positive relative to the axis of the body of the swimmer, as well as the thrust output of impeller 32, may be readily controlled by simple movements of the hand, wrist and forearm of the swimmer.

If desired, a similar assembly may be provided upon the other forearm of a swimmer, the controls of which may be operated independently of those upon the first forearm of the swimmer.

With further regard to the electrical block diagram of FIG. 8, in a preferred embodiment, the PWM signal of circuit 52 will define a frequency of about 50 Hertz and include modulated pulses having a width of between about 1 and about 2 milliseconds, with a repetition of such pulses of about 20 milliseconds each. Further, through the use of Hall effect controller 50, the output voltage of DC power supply 16/16A will fall within a range of 0 to about 30 volts DC.

Many of the components of the present system are readily available to the public. For example, an appropriate Hall effect switch, providing a linear output using a push button control is sold by Otto Engineering of Carpentersville, Ill. 60110. An appropriate thruster corresponding to elements 32, 36 and 40 above is sold by CrustCrawler of Gilbert, Ariz. 85233. An appropriate product of CrustCrawler is their 50 volt rated 400 HFS-L high-flow thruster. Other suitable thrusters, such as the Sea Botix 150, are sold by Hollis Gear of Irvine, Calif. Further, an appropriate brushless DC motor may be purchased from CrustCrawler.

In view of the above, it is to be appreciated that there is provided a propulsion system in which the power source thereof is self-contained and which may be readily positioned relative to the forearm of the swimmer without need for any anatomical intervention other than that of the use of a wrist and hand of one arm of the swimmer. This excludes the need for any form of external electrical or mechanical connection beyond the immediate area of the propulsion unit that constitutes a risk factor in prior art solutions such as that of Bruce, above.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A propulsion system for use by a swimmer in both on-water and under-water applications, the system comprising:

(a) at least one power supply integrally secured upon a sleeve, the sleeve in turn secured against and about a forearm of the swimmer;

(b) at least one propulsion unit each including a thruster having an impeller therewith from which hydrodynamic thrust results, the thruster in electrical communication with the power supply, said propulsion unit within a housing and having a bracket pivotally securing it to said sleeve, said unit extending in a direction laterally offset away from said forearm and distally and away from the head of the swimmer;

(c) control means for said power supply and propulsion units, said control means including:

(i) means for pitch control of a longitudinal axis of said propulsion unit by rotation of a flexion axis of a wrist of the swimmer, said pitch control means including a pivot point of said pivotally secured bracket; and (ii) means for control of thrust of said propulsion unit by said power unit, said power control and pitch control means positioned relative to said sleeve for accessibility by a hand of the swimmer.

2. The system as recited in claim 1, in which said control means comprises:

thumb, finger and wrist accessible controls for said flexion axis pitch control and said power control means, each of said means surrounded by a housing.

3. The system as recited in claim 2, in which said power control means includes a Hall-effect voltage controller.

4. The system as recited in claim 1, in which said sleeve comprises an extension of a lower arm covering of the swimmer.

5. The system as recited in claim 3, in which said power control means comprises a circuit including a motor controller, itself controlled by a PWM circuit controlled by said Hall-effect voltage controller.

6. The system as recited in claim 2, in which said control means exhibits axial resilience at a proximal end thereof.

7. The system as recited in claim 2, in which a housing about said bracket further comprises a substantially rigid radial member pivotally securing said propulsion unit to said forearm proximally to a wrist of the swimmer.

8. The system as recited in claim 2, said shroud-like cover of said impeller defining a nozzle.

9. The system as recited in claim 2, in which said pitch control means comprises:

means for tilting of the axis of the propulsion unit about the forearm of the swimmer.

10. The system as recited in claim 8, in which said system defines a specific gravity of between about 1.0 and about 1.25.

11. The system as recited in claim 1, in which said pitch control means of said propulsion unit includes an elongate control handle operable by extension and flexion of a wrist of the swimmer.

12. The system as recited in claim 1, in which one of which said at least one power supply unit, motor, propulsion unit and controls thereof further include a system comprising a second of said elements similarly proportioned to the forearm of the swimmer, wherein each of said controls upon a second forearm may be controlled independently of those upon the first forearm of the swimmer.

13. The system as recited in claim 5, in which said motor comprises a DC brushless motor.

14. The system as recited in claim 5, in which a PWM signal of said control means comprises a frequency of about 50 Hertz, modulated pulses having a width of between about 1 and about 2 milliseconds, and a repetition of said pulses about 20 milliseconds each.

15. The system as recited in claim 5, in which an output of voltage of said power unit falls within a range of about zero and about 30 volts DC.

16. The system as recited in claim 12, in which each power supply unit includes one or more DC batteries in electrical communication with said motor power controller.

* * * * *